United States Patent [19]

Koller

[11] Patent Number: 4,821,693

[45] Date of Patent: Apr. 18, 1989

[54] CAMSHAFT FOR AN INTERNAL COMBUSTION ENGINE

[75] Inventor: Gerhard Koller, Ditzingen, Fed. Rep. of Germany

[73] Assignee: Ing. h.c.F. Porsche Aktiengesellschaft, Stuttgart, Fed. Rep. of Germany

[21] Appl. No.: 131,502

[22] Filed: Dec. 11, 1987

[30] Foreign Application Priority Data

Dec. 20, 1986 [DE] Fed. Rep. of Germany ..... 3643673

[51] Int. Cl.[4] ..... F01L 1/04

[52] U.S. Cl. ..... 123/193 H

[58] Field of Search ..... 123/90.1, 90.6, 90.34, 123/193 H, 90.27

[56] References Cited

U.S. PATENT DOCUMENTS

| | | | |
|---|---|---|---|
| 1,840,314 | 1/1932 | Gerard | 123/90.34 |
| 4,535,733 | 8/1985 | Honda | 123/90.17 |
| 4,553,510 | 11/1985 | Yano et al. | 123/90.34 |

FOREIGN PATENT DOCUMENTS

| | | | |
|---|---|---|---|
| 8503825 | 2/1985 | Fed. Rep. of Germany . | |
| 1217835 | 5/1960 | France . | |
| 1511082 | 1/1968 | France . | |
| 0025711 | 3/1978 | Japan | 123/90.34 |
| 1044801 | 9/1983 | U.S.S.R. | 123/90.34 |
| 0558779 | 1/1944 | United Kingdom . | |

*Primary Examiner*—Willis R. Wolfe
*Assistant Examiner*—M. Macy
*Attorney, Agent, or Firm*—Barnes & Thornburg

[57] ABSTRACT

A camshaft for an internal combustion engine which is arranged in bearings that are formed by a cylinder head and a camshaft bearing housing. The camshaft is secured either at the cylinder head or at the camshaft bearing housing by means of holders, i.e., it represents together with one of the two housings of the internal combustion engine a preassembled structural unit. As a result thereof, the assembly of the camshaft becomes more simple.

12 Claims, 3 Drawing Sheets

CAMSHAFT FOR AN INTERNAL COMBUSTION ENGINE

BACKGROUND AND SUMMARY OF THE INVENTION

The present invention relates to a camshaft for an internal combustion engine which serves for the actuation of valves and is arranged in bearings of housings of the internal combustion engine formed by a cylinder head and a camshaft bearing housing.

A known camshaft (French Pat. No. 15 11 082) is arranged in bearings which are represented by housings of an internal combustion engine assembled in a plane and constructed as cylinder head and camshaft bearing housing. The camshaft bearing housing which has the form of a hood, is retained at the cylinder head by means of bolts. If the camshaft bearing housing is detached, then several push rods of valves which are under spring force, displace the camshaft into a position disposed outside of the assembly position.

It is the object of the present invention to undertake such measures on a camshaft that its assembly in bearings which are formed by a camshaft bearing housing and a cylinder head, is simple.

The underlying problems are solved according to the present invention in that the camshaft forms together with a housing a structural unit preassembled independently of the bearings, whereby the camshaft is connected with the housing by means of at least one holder or support member.

The principal advantages achievable with the present invention reside in that the holder retains the camshaft in a housing—cylinder head or camshaft bearing housing—in a preassembled position, as a result of which the connection of the housings forming the camshaft bearings is more simple because the camshaft is already in a position similar to the assembled position. It is also assured by the holder that during the detachment of a housing, for example, of the camshaft bearing housing, the camshaft remains in a position which can be readily handled.

If the internal combustion engine is equipped with parallel camshafts which actuate four valves per cylinder, then in addition to the facilitated assembly of the two housings—cylinder head and camshaft bearing housing—these camshafts can be preadjusted relative to one another by the holders. The holders are simple structural parts and can be secured without great expenditure at one of the two housings.

BRIEF DESCRIPTION OF THE DRAWINGS

These and other objects, features and advantages of the present invention will become more apparent from the following description when taken in connection with the accompanying drawing which shows, for purposes of illustration only, several embodiments in accordance with the present invention, and wherein.

DETAILED DESCRIPTION OF THE DRAWING

Figure 1:
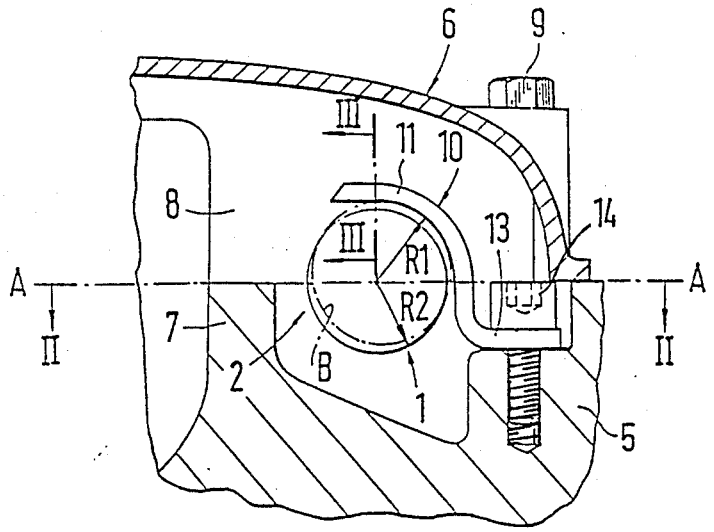
FIG. 1 is a cross-sectional view through an internal combustion engine within the area of a camshaft in accordance with the present invention.

Referring now to the drawing wherein like reference numerals are used throughout the various views to designate like parts, a camshaft generally designated by reference numeral 1 for the actuation of valves (not shown) which are held under spring stress, is arranged in bearings 2, 3 and 4 which are formed by housings of an internal combustion engine. In the illustrated embodiment the housings are a cylinder head 5 and a hood-shaped camshaft bearing housing 6 which are assembled in a separating plane A—A extending perpendicularly to the cylinder axis (not shown), whereby each bearing 2 includes bearing halves 7 and 8 which are integrated into the cylinder head 5 and camshaft bearing housing 6 respectively. The camshaft bearing housing 6 is retained at the cylinder head 5 by means of several bolts 9.

The camshaft 1 cooperates with a holder generally designated by reference numeral 10 in such a manner that it forms together with the cylinder head 5, a preassembled structural unit. The holder 10 includes a ring-like support section 11 which surrounds a part of the shaft area 12 of the camshaft 1 with slight spacing, i.e., the radius $R_1$ of the support section 11 is greater than the radius $R_2$ of the camshaft 1. Therebeyond, the holder 10 is provided with a securing flange 13 which extends laterally from the camshaft 1—parallel to the plane A—A—and is retained at the cylinder head 5 by means of a bolt 14.

Figure 3:
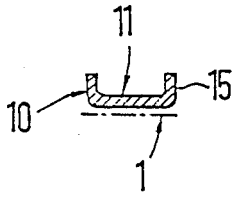
FIG. 3 is a cross-sectional view taken along line III—III of FIG. 1.

For reinforcing the holder 10, the latter is provided with a U-shaped profiling 15 (FIG. 3) within the area of the support section 11.

Figure 2:
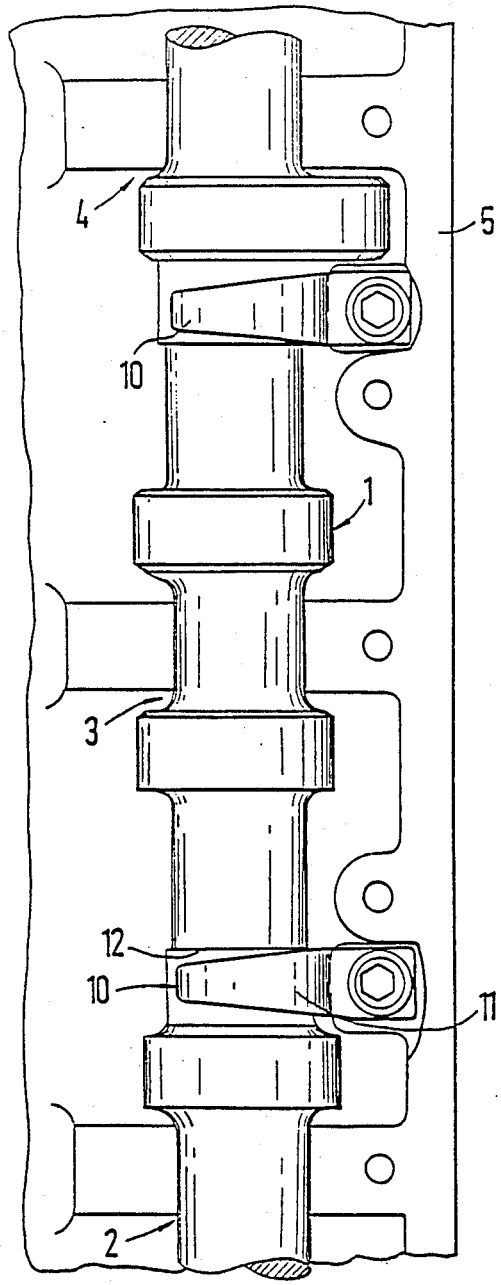
FIG. 2 is a cross-sectional view taken along line II—II of FIG. 1.

According to FIG. 2, two holders 10 are provided over the length of the camshaft 1 which are structurally identical.

If the camshaft housing 6 is detached from the cylinder head 5, the camshaft 1 assumes the position B (FIG. 1) by reason of the valves which are held under spring stress; it remains in an easily manipulatable base position.

Figure 4:
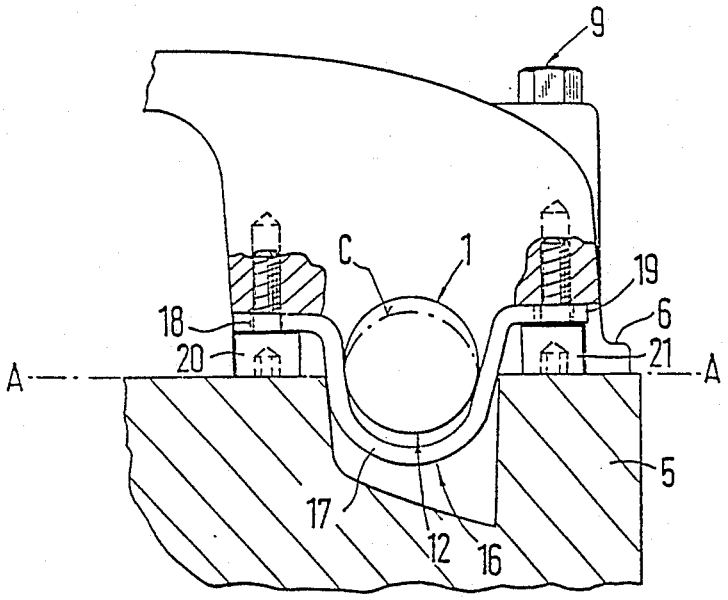
FIG. 4 is a cross-sectional view, similar to FIG. 1, of a modified embodiment in accordance with the present invention.

According to FIG. 4, the holder 16 surrounds by means of a half-shell-shaped support section 17 the shaft area 12 of the camshaft 1 whereby it is provided with fastening flanges 18 and 19 which extend on both sides of the camshaft 1—parallel to 20 the plane A—A. The fastening flanges 18 and 19 are retained at the camshaft bearing housing 6 by means of bolts 20 and 21.

Owing to the holder 16, the camshaft 1 forms together with the camshaft bearing housing 6 a preassembled unit whereby the camshaft 1 has the position C.

Figure 5:
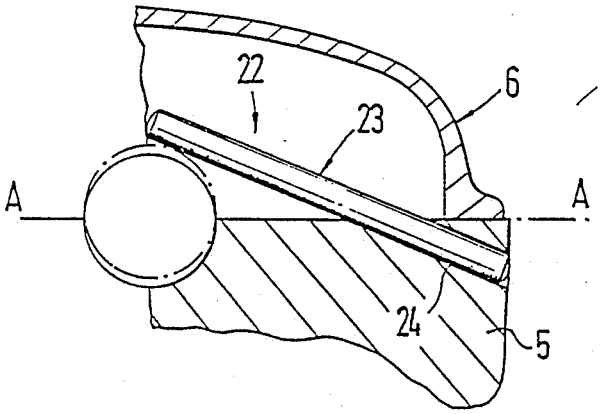
FIG. 5 is a cross-sectional view, similar to FIG. 1, of a still further modified embodiment in accordance with the present invention.

Finally, the camshaft 1 can also cooperate with a holder 22 (FIG. 5) which is illustrated by a straight cylindrical pin 23. The pin 23 extends obliquely to the plane A—A and protrudes over the camshaft 1 whereby it is fixed in a bore 24 of the cylinder head 5.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A camshaft mounting for an internal combustion engine which serves for the actuation of valves; cooperating bearing means; said camshaft being arranged in said cooperating bearing means which are formed by a cylinder head bearing housing means and a camshaft bearing housing means; the camshaft forming together with one of the bearing housing means a structural unit preassembled independently of the other bearing housing means; and at least one holder means for connecting the camshaft with the one bearing housing means.

2. A camshaft according to claim 1, wherein said one housing means is one of a cylinder head and camshaft bearing housing.

3. A camshaft according to claim 1, wherein the holder means surrounds a shaft area of the camshaft by means of a ring-like support section.

4. A camshaft according to claim 3, wherein said holder means surrounds the camshaft by means of the ring-like support section over only a partial area thereof and with a slight spacing.

5. A camshaft according to claim 3, wherein the holder means includes a fastening flange which extends laterally of the camshaft and is retained at the one bearing housing means by means of a bolt.

6. A camshaft according to claim 5, wherein the holder means is provided with a reinforced cross-sectional profiling, at least with the area of the support section.

7. A camshaft according to claim 3, wherein the support section of the holder means surrounds the shaft area of the camshaft with a half-circular-shaped portion and is secured at said one bearing housing means on fastening flanges extending on both sides of the camshaft by the use of bolt means.

8. A camshaft according to claim 1, wherein the holder means is a cylindrical pin that extends over the camshaft.

9. A camshaft according to claim 8, wherein the pin is fixed in a bore of the one housing means.

10. A camshaft according to claim 1, wherein at least two holder means are provided distributed over the length of the camshaft.

11. A camshaft according to claim 1, wherein the holder means includes a fastening flange which extends laterally of the camshaft and is retained at the one bearing housing means by means of a bolt.

12. A camshaft according to claim 3, wherein the holder means is provided with a reinforced cross-sectional profiling, at least within the area of the support section.

* * * * *